United States Patent [19]

Hartmann et al.

[11] Patent Number: 4,678,484

[45] Date of Patent: Jul. 7, 1987

[54] ELECTROFILTER

[75] Inventors: Wolfgang Hartmann, Frankfurt am Main; Paul G. Gocht, Mörfelden/Walldorf, both of Fed. Rep. of Germany

[73] Assignee: Metallgesellschaft Aktiengesellschaft, Frankfurt am Main, Fed. Rep. of Germany

[21] Appl. No.: 882,175

[22] Filed: Jul. 7, 1986

[30] Foreign Application Priority Data

Jul. 12, 1985 [DE] Fed. Rep. of Germany ..... 3524861

[51] Int. Cl.[4] ..... B03C 3/76

[52] U.S. Cl. ..... 55/112; 55/120; 55/135; 55/137; 55/151; 55/154; 55/146

[58] Field of Search ..... 55/11, 13, 112, 120, 55/128, 130, 134, 135, 136, 139, 146, 147, 148, 151, 154

[56] References Cited

U.S. PATENT DOCUMENTS

| | | | |
|---|---|---|---|
| 1,393,712 | 10/1921 | Steere et al. | 55/147 |
| 1,790,961 | 2/1931 | Welch | 55/128 |
| 3,166,389 | 1/1965 | Kappis et al. | 55/146 |
| 3,673,768 | 7/1972 | Leonard | 55/135 |
| 4,305,736 | 12/1981 | Kahl et al. | 55/112 |

FOREIGN PATENT DOCUMENTS

| | | |
|---|---|---|
| 565063 | 11/1930 | Fed. Rep. of Germany . |
| 556706 | 8/1932 | Fed. Rep. of Germany . |
| 1093447 | 7/1959 | Fed. Rep. of Germany . |
| 1532998 | 2/1966 | Fed. Rep. of Germany . |
| 2755059 | 6/1979 | Fed. Rep. of Germany . |
| 2135599 | 9/1984 | United Kingdom . |

*Primary Examiner*—Bernard Nozick

*Attorney, Agent, or Firm*—Felfe & Lynch

[57] ABSTRACT

Disclosed is an electrofilter for the removal of dust from gases under a pressure of up to 30 bar and a temperature up to 500° C. The electrofilter has a vertical cylindrical pressure casing having a lower chamber for the accommodation of the precipitating electrodes and spray electrodes, an upper chamber for the connection of the gas ducts and the disposition of the insulators, as well as a funnel-shaped dust collector. The upper chamber is divided horizontally and vertically by walls to permit a double-filter effect, and to thermally insulate the insulators from the flowing-gas chamber.

15 Claims, 1 Drawing Figure

ELECTROFILTER

BACKGROUND OF THE INVENTION

The invention relates to an electrofilter for the removal of dust from gases which are at pressures of up to 30 bar and temperatures of up to 500° C.

Examples of the removal of dust from gases in the above-named pressure and temperature range are the pressure gasification of coal and low-temperature coal distillation processes. The gases produced as reaction product in such processes at high temperature and pressure are preferably further processed or utilized without losses of pressure or temperature, but first impurities have to be removed from them. Owing to the nature of the process of the pressure gasification of coal the product gas carries ash particles which have to be removed. In the low-temperature distillation process it is often necessary to perform a dry gas cleaning in a fluidized bed, followed by removal of dust in the electrofilter. Clearly, specially designed electrofilters are needed for such applications.

Insofar as it can be seen, no electrofilter has ever yet been disclosed in which all of the constructional and functional difficulties arising from the pressure and temperature levels have been satisfactorily solved. It has been proposed to purify gases at high pressure in an electrofilter in which the casing itself consists of a thick-walled tube and serves as the precipitating electrode (DE-PS 565 063), or to purify high-temperature gases by means of tubular precipitating electrodes which are designed to carry a flowing coolant (DE-OS 27 55 059). The first proposal is not unconditionally suitable for high temperatures, and also it is uneconomical for large quantities of gas. The second proposal is not designed for the case in which a high pressure is simultaneously present, and it entails unnecessarily high heat losses.

The problem thus exists of devising an electrofilter which will be suitable for the removal of dust from gases at a pressure of up to 30 bar and a temperature up to 500° C., and which can be constructed and operated at economically acceptable cost.

SUMMARY OF THE INVENTION

The drawbacks of prior apparatus are overcome by the present invention. The present invention is in an electrofilter which comprises:

(a) a vertical cylindrical pressure casing having a bottom chamber for the accommodation of the precipitating electrodes and the spray electrodes, an upper chamber for the connection of the gas ducts and the arrangement of the insulators, as well as a conically tapering dust hopper, (b) two clusters of tubular precipitating electrodes through which the gas stream passes successively from top to bottom and then from bottom to top, and a corresponding number of spray electrodes disposed centrally in the precipitating electrodes and held taut by means of weights, (c) a vertically through-going wall for the separation of the gas inlet side from the gas outlet side, and a horizontal wall with openings for the spray electrode supporting elements to shield the insulators from the flowing-gas area in the upper chamber, and (d) a gas-tight housing outside of the pressure casing for the voltage-bearing parts between the high-voltage system and insulators.

The cylindrical pressure casing is preferably constructed of two parts joined together, while the upper part of the pressure casing in the area of the insulators can have heaters inside and outside, and the dust hopper can have heaters on the outside in the area of the outlet. Furthermore, insulation can be provided on the outside of the pressure casing and housing to minimize or prevent heat losses. Variations of spacing in the area of the high-voltage system are advantageously avoided by setting up the high-voltage system on brackets which are joined to the upper part of the pressure casing. Furthermore, a knocker system for cleaning the precipitating electrodes is provided in the pressure casing in a known manner, and a means for driving the knockers are provided outside of the pressure casing. The movement of the apparatus for cleaning the precipitating electrodes is transmitted into the interior of the pressure casing in a contactless manner. For the cleaning of the spray electrodes, a system is provided outside of the pressure casing for cleaning by knocking, the impulses of which can be transferred mechanically by the insulators to the supporting elements of the spray electrodes.

The horizontal wall provided in the upper chamber is preferably insulated and has downwardly extending tubes which surround the supporting elements and have bell-mouth flares at their extremities.

Lastly, provision is also made for disposing on the upper part of the pressure casing, above the horizontal wall, connections for the entry and discharge of a scavenging gas.

The various features of novelty which characterize the invention are pointed out with particularity in the claims annexed to and forming a part of this specification. For a better understanding of the invention, its operating advantages and specific objects obtained by its use, reference should be had to the accompanying drawing and descriptive matter in which there is illustrated and described a preferred embodiment of the invention.

BRIEF DESCRIPTION OF THE DRAWING

The FIGURE shows in a greatly simplified manner a vertical section through an electrofilter of the invention.

DESCRIPTION OF THE PREFERRED EMBODIMENT

Figure 1:
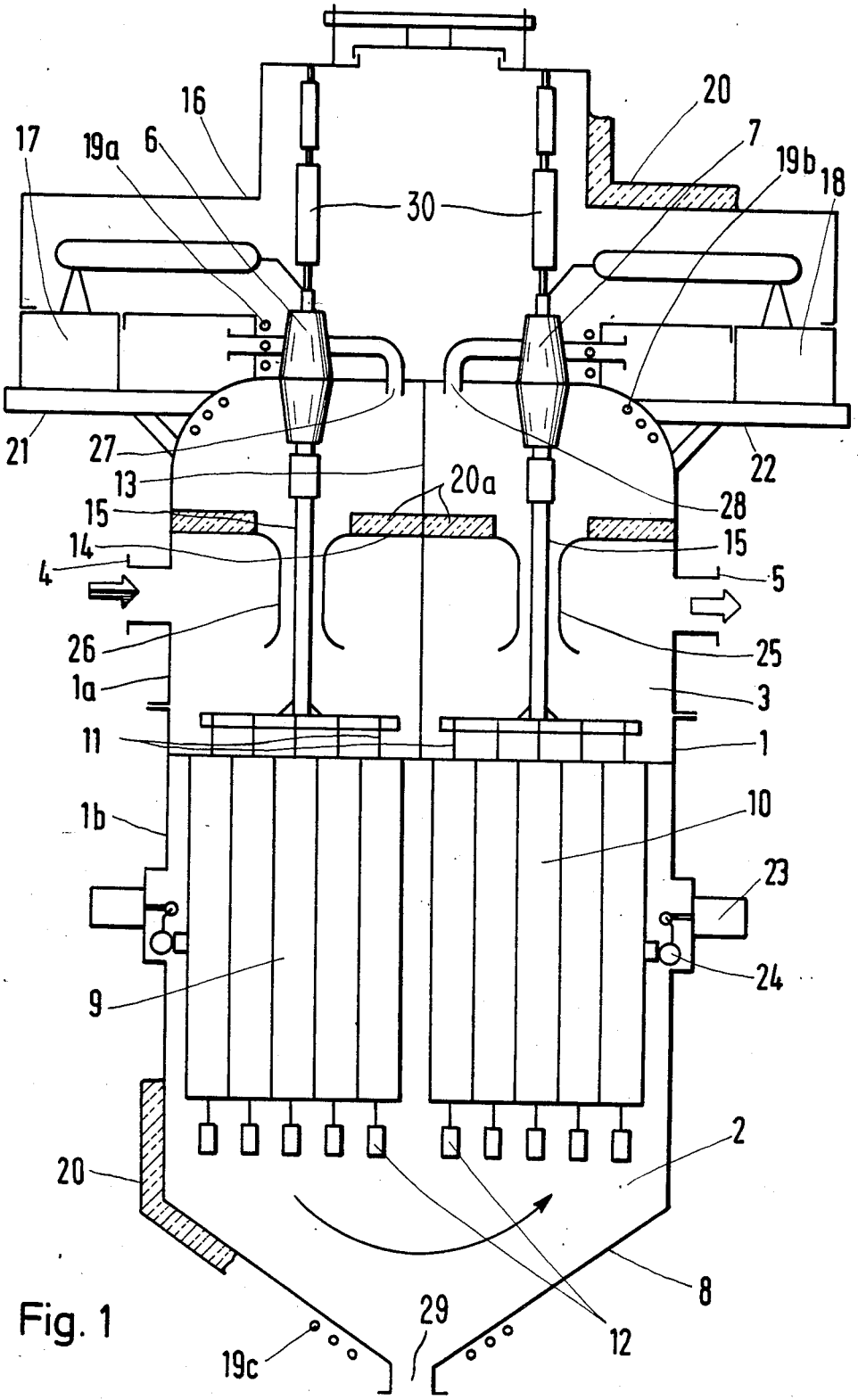

Referring to the FIGURE, a vertically disposed cylindrical pressure casing 1 is formed of an upper section 1*a* and lower section 1*b*. Lower section 1*b* houses a lower chamber 2 adapted to accommodate precipitating electrodes 9 and 10 and spray electrodes 11. Spray electrodes 11 are tensed by means of weights 12. Pressure casing 1 has an upper chamber 3 which has inlet and outlet gas duct connection 4 and 5 respectively and insulators 6 and 7. Section 1*b* is formed with a conically tapering dust hopper 8.

The tubular precipitating electrodes 9 and 10 are divided into two clusters through which the gas stream, having entered into chamber 3 through inlet duct 4, passes successively from chamber 3 to chamber 2 and then from chamber 2 to chamber 3. The spray electrodes 11 are, as usual, disposed centrally within the precipitating electrodes 9 and 10. The upper chamber 3 has a wall 13 running vertically from top to bottom to separate the gas entry side from the gas exit side, and a horizontal wall 14 with openings for the supporting elements 15 of the spray electrodes 11 to shield the insulators 6 and 7 from the flowing-gas area. Outside of pressure casing 1 is a gas-tight housing 16 for the voltage-carrying parts between the high-voltage system 17 and 18 and insulators 6 and 7.

The cylindrical pressure casing 1 consists of two sections 1*a* and 1*b* joined together in a gas-tight manner. The upper section 1*a* of the pressure casing 1 is provided inside and out, in the area of the insulators 6 and 7, with heaters 19*a* and 19*b*. The dust collecting hopper 8 has a heater 19*c* on the outside adjacent its outlet 29. Furthermore, the entire pressure casing 1 and the housing 16 are provided on the outside with insulation 20 which, for purposes of simplicity, is indicated only partially in the FIGURE.

The high-voltage system 17 and 18 is supported on brackets 21 and 22 which are joined to the upper part 1*a* of the pressure casing 1. It is in this manner that expansions of material due to pressure and/or temperature effects are prevented from producing changes in the distance between the grounded and high-voltage parts which might produce undesirable flashovers or even short circuits.

Pressure casing 1 also is provided with a cleaning device 23 for cleaning off the precipitation electrodes 9 and 10 by knocking. System 23 drives the cleaning device and is provided outside of the pressure casing 1. The knocker drive 24 is brought through the pressure casing without contact and therefore requires no special sealing. Outside of the pressure casing 1 there is also provided a means 30 for cleaning the spray electrodes 11 by knocking, the pulses of which are transmitted mechanically through the insulators 6 and 7 to the supporting elements 15 of the spray electrodes 11. For the further protection of the insulator pass-through area against the effects of heat from the gas chamber, the horizontal wall 14 is provided with insulation 20*a*. The supporting elements 15 are concentrically surrounded by protective tubes 25 and 26 which extend downwardly from the horizontal wall 14 and are bell-mouthed at the ends. In this manner the cross section between the high-voltage-bearing supporting elements 15 and the parts of the grounded casing surrounding them is reduced to a minimum, which is of great importance for the thermal separation between the gas chamber and the area where the insulators are brought through. The same purpose is served by connections 27 and 28 disposed on the upper part 1*a* of the pressure casing 1 above the horizontal wall, for the entry and exit of a scavenging gas. In this manner a pressure elevation above the pressure in the gas chamber is sustained above the wall 14, so that no hot gases can penetrate into the upper part through the gap between the supporting elements 15 and the protective tubes 25 and 26.

The configuration, as exemplified in the Figure has the advantage that two electrical fields can be disposed in one pressure casing, through which the gases flow alternately from top to bottom and then from bottom to top. The gas infeed and exhaust lines are in a single plane. The continuous vertical wall 13 in the upper chamber 3 assures the separation of the two fields from one another and thus provides for the guidance of the gas, as described.

The insulators 6 and 7 are maintained at a temperature below 200° C. by the use of the insulated horizontal wall 14 in the upper chamber 3 of the pressure casing 3 and by the use of a scavenging gas, so that the insulated lead-through of the high voltage through the grounded wall of the pressure casing 1 can be accomplished at economically acceptable expense. The unavoidable open cross sections between the supporting elements 15 and the protective tubes 25 and 26 concentrically surrounding them are blocked against the passage of process gas by the establishment of a correspondingly higher pressure in the scavenging gas chamber. Heaters 19*a* and 19*b* are provided for the purpose of preventing the surfaces of the insulators 6 and 7 from falling below the dew point, which could lead to the deposit of moisture and consequently to a degration of the insulation.

The protective tubes 25 and 26 with their bell-mouthed ends make it possible, as already mentioned, to keep the openings for the admission of process gas into the insulatcr chamber to a minimum and thus limit consumption of the scavenging gas. The scavenging gas can be nitrogen, carbon dioxide or even fuel gases preheated to, for example, 180° C., or else cooled below that.

The gas-tight housing 16 of the voltage-bearing parts between the high-voltage systems 17 and 18 and insulators 6 and 7 are preferably maintained under a slight overpressure of inert gas to prevent dust or other impurities from depositing on the surface of the insulators 6 and 7. The entry and exit of scavenging gas is preferably monitored with flow meters so that any disturbances can be immediately detected.

In the case of higher gas pressures, electrofilters have to be operated at higher working voltages. Allowance must be made for this outside of the pressure area by the appropriate selection of the spacing between the high-voltage-bearing parts and the grounded protective systems in order to prevent flashover. The connections between the high-voltage system 17 and the insulators 6 and 7 are therefore in the form of large-area metal cylinders and metal hemispheres which are opposite the grounded housing.

The pressure casing can be up to 10 meters high, so that changes in length can occur as a result of thermal stress and pressure which produce their greatest effect in the area of the insulators 6 and 7. For the prevention of relative movements between high-voltage system 17 and 18 and pressure casing 1, the high-voltage system is therefore mounted on brackets 21 and 22 which are directly connected to the upper part of the casing 1.

It is apparent that the electrofilter according to the invention satisfies all of the requirements which must be met in the removal of dust from gas at a pressure up to 30 bar and a temperature up to 500° C. and permits a reliable and economical solution of the problem addressed.

It will be understood that the specification and embodiment described herein is illustrative but not limitative of the present invention and that other embodiments within the spirit and scope of the invention will suggest themselves to those skilled in the art.

We claim:

1. An electrofilter for the removal of dust from a gas at a pressure of up to 30 bar and a temperature up to 500° C., comprising:

a vertically extending, gas tight cylindrical pressure vessel having an upper and a lower chamber, said lower chamber having a conically tapered dust collecting hopper and housing a plurality of precipitating electrodes and a corresponding number of spray electrodes in said lower chamber, the spray electrodes being disposed within said precipitating electrodes; insulators disposed in said upper chamber;

separating means for separating a gas entry side from a gas exit side of the vessel;

gas inlet and gas outlet means in said upper chamber so as to direct the gas through the electrodes of the gas entry side from top to bottom and cause the gas to flow through the electrodes of the gas exit side from the bottom to top;

support means for supporting said spray electrodes;

a structure with openings for the support means of the spray electrodes, said structure shielding said insulators from said gas in the upper chamber; and gas-tight means for housing voltage-carrying parts between a high-voltage system and the insulators.

2. The electrofilter of claim 1, wherein the upper part of the pressure vessel has heating means inside and outside in the area of the insulators.

3. The electrofilter of claim 1, wherein the pressure vessel is insulated.

4. The electrofilter of claim 1, wherein the high-voltage system is supported by support means joined to the upper part of the pressure vessel.

5. The electrofilter of claim 1, further comprising means for cleaning the spray electrodes, whose pulses are transmittable mechanically through the insulators to the supporting elements of the spray electrodes.

6. The electrofilter of claim 1, wherein said structure is insulated.

7. The electrofilter of claim 1, further comprising connections to introduce and exhaust a scavenging gas in the upper part of the pressure vessel above said structure.

8. The electrofilter of claim 1, wherein the dust collecting hopper has heating means on the outside in the area of the outlet.

9. The electrofilter of claim 1, wherein said spray electrodes are centrally located in said precipitating electrodes.

10. The electrofilter of claim 1, further comprising cleaning means for cleaning the precipitating electrodes.

11. The electrofilter of claim 10, wherein the cleaning means comprises a knocking means.

12. The electrofilter of claim 11, wherein the knocking means includes a driving means outside of the pressure vessel.

13. The electrofilter of claim 12, wherein the knocking means is driven in a contactless and packing-free manner.

14. The electrofilter of claim 1, wherein protective means extend downwardly from said structure and surround said support means.

15. The electrofilter of claim 14, wherein said protective means have a trumpet-like flare at an extremity thereof.

* * * * *